US010897974B2

(12) United States Patent
Passarello

(10) Patent No.: US 10,897,974 B2
(45) Date of Patent: Jan. 26, 2021

(54) HEADBAND WITH 360-DEGREE GLITTER PATTERN

(71) Applicant: SPARKLY SOUL INC., New York, NY (US)

(72) Inventor: Dari Passarello, New York, NY (US)

(73) Assignee: Sparkly Soul, Inc., Westport, CT (US)

( * ) Notice: Subject to any disclaimer, the term of this patent is extended or adjusted under 35 U.S.C. 154(b) by 443 days.

(21) Appl. No.: 14/815,289

(22) Filed: Jul. 31, 2015

(65) Prior Publication Data

US 2015/0335124 A1 Nov. 26, 2015

Related U.S. Application Data

(63) Continuation-in-part of application No. 13/978,391, filed as application No. PCT/US2012/048081 on Jul. 25, 2012, now Pat. No. 9,173,467.

(60) Provisional application No. 61/512,696, filed on Jul. 28, 2011.

(51) Int. Cl.
*A45D 8/36* (2006.01)
*A45D 8/00* (2006.01)

(52) U.S. Cl.
CPC ..... *A45D 8/36* (2013.01); *A45D 2008/004* (2013.01); *Y10T 29/49872* (2015.01)

(58) Field of Classification Search
CPC ..... A45D 8/34; A45D 8/36; A45D 2008/345; A45D 2008/004; A45D 2008/006
See application file for complete search history.

(56) References Cited

U.S. PATENT DOCUMENTS

| | | | |
|---|---|---|---|
| D4,516 | S | 12/1870 | Smith |
| 354,882 | A | 12/1886 | Bracher |
| 409,001 | A | 8/1889 | Ashworth |
| D19,530 | S | 12/1889 | LaPierre |
| 478,291 | A | 7/1892 | Shrier |
| 497,085 | A | 5/1893 | Yule, et al. |

(Continued)

FOREIGN PATENT DOCUMENTS

| | | |
|---|---|---|
| CA | 144200 | 11/2012 |
| CN | 2678415 Y | 2/2005 |

(Continued)

OTHER PUBLICATIONS

International Search Report for Int. App No. PCT/US2016/045062, dated Oct. 6, 2016 (2 pages).

(Continued)

*Primary Examiner* — Rachel R Steitz
*Assistant Examiner* — Brianne E Kalach
(74) *Attorney, Agent, or Firm* — Fish & Richardson P.C.

(57) ABSTRACT

A headband or head cover including an elastic glitter or plain ribbon, a top portion of which forms the outside of the headband, where the elastic glitter or plain ribbon has a substantially 360-degree glitter pattern. The headband further includes a stretch velvet ribbon, a bottom portion of which forms the inside of the headband. The elastic glitter or plain ribbon is attached to the stretch velvet ribbon using a stretch and stitch method. The bottom of the stretch velvet ribbon includes a velvet-like material that forms a gripping portion. The outside of the headband includes a 360-degree view with no break. The inside of the headband includes 360-degree gripping portion with no break.

33 Claims, 5 Drawing Sheets

(56) References Cited

U.S. PATENT DOCUMENTS

| | | | | |
|---|---|---|---|---|
| 1,156,487 | A | 10/1915 | Kunstadter | |
| 2,116,082 | A | 5/1938 | Radford | |
| 2,294,654 | A | 9/1942 | Cooper | |
| 2,343,408 | A | 3/1944 | Glass | |
| 2,351,132 | A | 6/1944 | Kling | |
| 2,406,700 | A | 8/1946 | Miller | |
| 2,580,323 | A | 12/1951 | Russell | |
| 3,229,308 | A * | 1/1966 | Jensen | A45D 8/36 2/209.3 |
| 3,467,111 | A | 9/1969 | Benson | |
| 3,474,798 | A | 10/1969 | Tillotson | |
| 3,672,362 | A * | 6/1972 | Basche | A45D 44/22 606/204.35 |
| 3,832,841 | A * | 9/1974 | Cole | A45D 8/34 57/207 |
| 4,317,238 | A | 3/1982 | Amin | |
| 4,416,633 | A | 11/1983 | Gulack | |
| D272,865 | S | 3/1984 | Edelmann | |
| 4,499,741 | A * | 2/1985 | Harris | A41D 20/00 2/162 |
| 4,517,685 | A * | 5/1985 | Lesley | A41D 13/01 359/518 |
| 4,630,317 | A | 12/1986 | Brown | |
| 4,811,430 | A | 3/1989 | Janusz | |
| 4,833,734 | A | 5/1989 | Der Estephanian | |
| 4,910,806 | A | 3/1990 | Baker et al. | |
| 4,918,758 | A * | 4/1990 | Rendina | A63F 9/0098 2/171 |
| 4,947,488 | A | 8/1990 | Ashinoff | |
| D316,774 | S | 5/1991 | Falk | |
| 5,111,975 | A | 5/1992 | Roberts | |
| D343,282 | S | 1/1994 | Irish | |
| D351,052 | S | 10/1994 | Russell | |
| D355,047 | S | 1/1995 | Grimes | |
| D375,612 | S | 11/1996 | Elder | |
| 5,579,540 | A | 12/1996 | Walker | |
| D382,989 | S | 9/1997 | Simpson | |
| D384,790 | S | 10/1997 | Juergens | |
| D389,636 | S | 1/1998 | Davis | |
| 5,806,535 | A | 9/1998 | Becker | |
| D402,091 | S | 12/1998 | Bratcher | |
| 5,848,981 | A | 12/1998 | Herbranson | |
| 5,862,523 | A | 1/1999 | Proctor | |
| 5,963,989 | A | 10/1999 | Robertson | |
| 6,000,062 | A | 12/1999 | Trakh | |
| 6,115,843 | A | 9/2000 | Travalgia | |
| 6,205,590 | B1 | 3/2001 | Gorman | |
| 6,227,011 | B1 | 5/2001 | Cortinovis | |
| 6,237,611 | B1 | 5/2001 | LeCrone | |
| 6,295,992 | B1 | 10/2001 | Sapp | |
| 6,502,245 | B1 | 1/2003 | McBride | |
| 6,553,577 | B2 | 4/2003 | Montague | |
| 6,701,532 | B1 | 3/2004 | Glassberg et al. | |
| D497,467 | S | 10/2004 | Srivastava | |
| D511,036 | S | 11/2005 | Moses | |
| D519,716 | S | 5/2006 | Smith | |
| D528,744 | S | 9/2006 | Nelson | |
| 7,398,559 | B2 | 7/2008 | Flatt | |
| D578,742 | S | 10/2008 | Cho | |
| D668,843 | S | 10/2012 | Lalonde | |
| 8,276,216 | B2 | 10/2012 | Carney | |
| 9,392,827 | B2 | 7/2016 | Farney | |
| 2002/0043077 | A1 | 4/2002 | Boyadjian | |
| 2002/0055317 | A1 | 5/2002 | Kopelowicz | |
| 2003/0121127 | A1 | 7/2003 | Walker | |
| 2003/0131395 | A1 | 7/2003 | Putnam | |
| 2003/0221241 | A1 | 12/2003 | Rivera | |
| 2004/0213979 | A1 | 10/2004 | Vito et al. | |
| 2005/0061345 | A1 | 3/2005 | Srivastava | |
| 2005/0222608 | A1 | 10/2005 | Hou | |
| 2006/0032515 | A1 | 2/2006 | Thall | |
| 2006/0042139 | A1 | 3/2006 | Mendes | |
| 2006/0085891 | A1 | 4/2006 | Larkin | |
| 2006/0162046 | A1 | 7/2006 | Chudzik | |
| 2006/0249172 | A1 | 11/2006 | Bellew | |
| 2008/0022438 | A1 | 1/2008 | Schweers et al. | |
| 2008/0156340 | A1 * | 7/2008 | Hopper | A45D 8/36 132/275 |
| 2009/0090378 | A1 * | 4/2009 | Chudzik | A45D 8/36 132/273 |
| 2010/0107307 | A1 | 5/2010 | Lee | |
| 2010/0162464 | A1 | 7/2010 | Beard | |
| 2010/0206323 | A1 * | 8/2010 | August | A41D 20/00 132/273 |
| 2010/0242980 | A1 | 9/2010 | D'Assis | |
| 2012/0118317 | A1 | 5/2012 | Payne | |
| 2012/0180193 | A1 | 7/2012 | Curiel | |
| 2012/0234344 | A1 | 9/2012 | Hsu | |
| 2013/0291887 | A1 | 11/2013 | Passarello | |
| 2016/0029722 | A1 | 2/2016 | Klopfer | |
| 2017/0164662 | A1 | 6/2017 | Carney | |

FOREIGN PATENT DOCUMENTS

| | | |
|---|---|---|
| CN | 201700449 U | 1/2011 |
| CN | 302193829 | 11/2012 |
| EP | 001311914-0001 | 3/2012 |
| GB | 2 184 754 | 7/1987 |
| GB | 2 318 500 | 4/1998 |
| RU | 82529 U1 | 5/2009 |

OTHER PUBLICATIONS

SIPO Office Action for CN App No. 201280047814.X dated Mar. 1, 2016 (14 pages).

EPO Search Report for EP App No. 12818075.9, dated Oct. 20, 2015 (8 pages).

Sparkly Soul, photo post [on-line]; [posted to the Internet Jul. 31, 2011]; [retrieved from the Internet Nov. 8, 2016]; URL: https://www.facebook.com/sparklysoulinc/photos/a.263148203702249.85880.263148047035598/263148210368915/?type=3&theater (1 page).

Sparkly Thin Headband, [on-line]; [posted to the Internet with a crawlback date of Oct. 6, 2011]; [retrieved from the Internet Nov. 8, 2016]; URL: < https://web.archive.org/web/20111006045951 http://shop.sparklysoul.com/SparklySmallHeadband_c2.htm > (3 pages).

Sparkly Soul—Fitness Headbands, [on-line]; [posted to the Internet Feb. 22, 2013]; [retrieved from the Internet Nov. 8, 2016]; URL: < https://www.youtube.com/watch?γ=3aHOγaaixo4&feature=youtu.be22 (2 pages).

Goody Hair Bands (Gold and Burgundy Glitter), "Crowning Glory", Beauty Marie Claire, Marie Claire Magazine Dec. 2008, p. 150.

International Search Report of PCT/US2016/045062 dated Oct. 6, 2016.

"Come to diamond's this week . . . and leave 10 years behind!", [online] Diamonds; Tue Mar. 30, 1971; Arizona Republic, Downloaded on Dec. 17, 2017 (1 page).

International Search Report for Int. App No. PCT/US2012/048081, dated Oct. 11, 2012 (2 pages).

Lorraine Basche press photo, Face Up Hairbands; [online]; HistoricImages, (1 page).

Newspapers.com [online] "Demonstrations Scheduled for new Beauty Item", The Journal News (Hamilton, Ohio), Mon, Jun. 9, 1975, p. 5, Downloaded on Dec. 13, 2017 (1 page).

Newspapers.com [online], "Beauty Aid Like Mummy's", The Sydney Morning Herald (Sydney, New South Wales, Australia), Tue, Mar. 26, 1974, p. 14, Downloaded on Dec. 13, 2017 (1 page).

Newspapers.com [online], "Casa Linda Club Hears Program on 'Face Up' at Regular Meet", The Mexia Daily News (Mexia, Texas), Sun, Apr. 22, 1973, p. 2, Downloaded on Dec. 13, 2017 (1 page).

Newspapers.com [online], "Headband Erases Years from Face", The Daily Times-News (Burlington, North Carolina), Wed, Sep. 19, 1973, p. 23, Downloaded on Dec. 13, 2017 (1 page).

Newspapers.com [online], "Lorraine Basche Faces-Up to Her Age", Honolulu Star-Bulletin (Honolulu, Hawaii), Fri, Jul. 10, 1970, p. 23 Downloaded on Dec. 13, 2017 (2 pages).

Newspapers.com [online], "Lorraine Faces Up to Age Lines", The Tennessean (Nashville, Tennessee), Tue, Nov. 7, 1972, p. 17, Downloaded on Dec. 13, 2017 (1 page).

(56) References Cited

OTHER PUBLICATIONS

Newspapers.com [online], "New Beauty Aid Claimed: Instantaneous Face Lift"The Courier-News (Bridgewater, New Jersey), Wed, Sep. 20, 1972, Main Edition, p. 17, Downloaded on Dec. 13, 2017 (1 page).
Newspapers.com [online], "What Instant Face Lift Taut Me: The Sag Will Eventually Return", The Philadelphia Inquirer (Philadelphia, Pennsylvania), Mon, Jan. 21, 1974, Main Edition, p. 6, Downloaded on Dec. 13, 2017 (1 page).
Newspapers.com; [online] "Come to McAlpin's This Week . . . Go Home Looking Years Younger with the Face-Up Headband!", The Cincinnati Enquirer (Cincinnati, Ohio); Sun, Jun. 8, 1975; The Kentucky Enquirer, p. 140; Downloaded on Dec. 17, 2017 (1 page).

* cited by examiner

HEADBAND WITH 360-DEGREE GLITTER PATTERN

CROSS-REFERENCE TO RELATED APPLICATIONS

This application claims priority to U.S. patent application Ser. No. 13/978,391, which was filed in the U.S. Patent and Trademark Office on Jul. 30, 2013, which is a national stage patent application of International Patent Application No. PCT/US12/48081, filed on Jul. 25, 2012, which claims priority to U.S. Provisional Patent Application No. 61/512,696, which was filed in the U.S. Patent and Trademark Office on Jul. 28, 2011, all of which are incorporated herein by reference in their entirety for all purposes.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

BACKGROUND OF THE INVENTION

1. Field of the Invention

The embodiments of the present invention relate generally to a headband that includes a 360-degree glitter pattern that has no-headache, non-slip, and non-snag properties.

2. Description of the Related Art

Headbands are widely used by a variety of people, including athletes and others with long hair, with one of the purposes of the headband being to keep hair out of the wearer's field of vision. Headbands are conventionally found in a variety of styles and are popular among girls and women.

Headbands may be made of various materials. The design of the headbands of the prior art have problems with slipping, causing hair snag, or creating a headache for the wearer. Some headbands are made from rigid materials and are oblong in shape with an opening at the bottom end to slide over the head of the wearer where each end fits behind the wearer's ear to secure itself in place by pressure behind the ear. These styles can often cause the wearer discomfort as pressure is felt from the point of contact behind the ears. Other headbands are adjustable, which are advertised as being comfortable and can be worn during strenuous activity. These adjustable headbands may include a rubber band or an elastic material which can slide off the wearer's head during strenuous activity. Alternatively, these headbands can be uncomfortably tight to securely stay on the head, which can cause the wearer to develop headaches. These headbands may include a partial velvet lining but the velvet lining does not extend around the entire circumference of the headband.

Often, styles of headbands include a wraparound style headband that include a portion of a circular piece of elasticized material, which is secured in place by pressure from the elastic band as the elastic constricts around the head and hair of the wearer. These bands often slide off the wearer's head when used as a headband if they are not tightly fitted around the wearer's head. If a wraparound style headband does not include an elastic portion that has gripping properties, they tend to easily slide off a wearer's head.

Alternatively, many headbands of the prior art use a piece of black elastic to provide the "stretch" on the band, and do not have an elastic portion that wraps around the entire head—the band stops and the remainder is a plain elastic. While these headbands are marketed as "no slip," there is still a degree of slide due to the grip not going all the way around the band. These products cause a "headband headache" due to lack of elasticity and ride up the back of the head, pop off or irritate the ears.

Further, another popular category of headbands are headband that are made of Lycra or sweat wicking material. Such headbands tend to simply slide right off a user's head and do not remain secure for prolonged wear.

There is a continuing unmet need for headbands comprising comfortable fabric which remain comfortable during prolonged wear and remain secure, as well as comfortable and stylish, during vigorous activity.

SUMMARY OF THE INVENTION

In an aspect, a headband includes an elastic glitter ribbon, a top portion of which forms the outside of the headband, wherein the elastic glitter ribbon has an elasticity and a substantially 360-degree glitter pattern; a stretch velvet ribbon, a bottom portion of which forms the inside of the headband, wherein the stretch velvet ribbon has an elasticity, wherein the elastic glitter ribbon is attached to the stretch velvet ribbon using a stretch and stitch method, which maintains the elasticity of the elastic glitter ribbon and the stretch velvet ribbon, wherein both the elastic glitter ribbon and the stretch velvet ribbon are connected to make the headband a 360-degree elastic headband, wherein the elastic glitter ribbon comprises metallic threading ribbon or metallic yarn, wherein the bottom portion of the stretch velvet ribbon comprises a velvet-like material that forms a gripping portion, wherein the outside of the headband comprises the top portion of the elastic glitter ribbon that gives the headband a 360-degree view with no break, and wherein the inside of the headband comprises the bottom portion of the headband which forms the gripping portion that gives the headband a 360-degree gripping portion with no break.

In another aspect, a method of making a headband includes connecting ends of the elastic glitter ribbon to create an elastic glitter ribbon circle; connecting ends of the stretch velvet ribbon to create a stretch velvet ribbon circle; stretching the elastic glitter ribbon circle; stretching the stretch velvet ribbon circle; and attaching the stretched elastic glitter ribbon circle to the stretched stretch velvet ribbon circle to make the headband a 360-degree elastic headband.

In yet another aspect, a headband includes an elastic ribbon, a top portion of which forms the outside of the headband, wherein the elastic ribbon has an elasticity; a stretch ribbon, a bottom portion of which forms the inside of the headband, wherein the stretch ribbon has an elasticity, wherein the elastic ribbon is attached to the stretch ribbon using a stretch and stitch method, which maintains the elasticity of the elastic ribbon and the stretch ribbon, wherein both the elastic ribbon and the stretch ribbon are connected to make the headband a 360-degree elastic headband, wherein the bottom portion of the stretch ribbon comprises a gripping portion, wherein the outside of the headband comprises the top portion of the elastic ribbon which gives the headband a 360-degree view of the outside of the headband with no break, and wherein the inside of the headband comprises the bottom portion of the headband which forms the gripping portion that gives the headband a 360-degree gripping portion with no break.

In yet another aspect, a method of making a headband includes connecting ends of the elastic ribbon to create an elastic ribbon circle; connecting ends of the stretch ribbon to create a stretch ribbon circle; stretching the elastic ribbon circle; stretching the stretch ribbon circle; and attaching the stretched elastic ribbon circle to the stretched stretch ribbon circle to make the headband a 360-degree elastic headband.

In yet another aspect, a head cover includes an elastic ribbon, a top portion of which forms the outside of the head cover and a bottom portion of which forms the inside of the head cover; wherein the ends of the elastic ribbon are connected to make the head cover a 360-degree elastic head cover, wherein the bottom portion of the elastic ribbon comprises a velvet backing that forms a gripping portion, wherein the outside of the head cover comprises the top portion of the elastic ribbon that gives the head cover a 360-degree surface with no break, and wherein the inside of the head cover comprises the bottom portion of the elastic ribbon comprising the velvet backing which forms the gripping portion that gives the head cover a 360-degree gripping portion with no break.

In yet another aspect, a method of making a head cover includes connecting ends of the elastic ribbon to create an elastic ribbon circle; connecting ends of the velvet backing to create a velvet backing circle; stretching the elastic ribbon circle; stretching the velvet backing circle; attaching the stretched elastic ribbon circle to the stretched velvet backing circle to make the head cover a 360-degree elastic head cover.

In yet another aspect, a headband includes an elastic ribbon, a top portion of which forms the outside of the headband; a stretch velvet ribbon, a bottom portion of which forms the inside of the headband, wherein the stretch velvet ribbon has an elasticity, wherein the elastic ribbon is attached to the stretch velvet ribbon using a stretch and stitch method, which maintains the elasticity of the elastic ribbon and the stretch velvet ribbon, wherein both the elastic ribbon and the stretch velvet ribbon are connected and the headband is a 360-degree elastic headband, wherein the bottom portion of the stretch velvet ribbon comprises a velvet-like material that forms a gripping portion, wherein at least a region on the outside of the headband comprises the top portion of the elastic ribbon, and wherein at least a region on the inside of the headband comprises the bottom portion of the headband which forms the gripping portion.

BRIEF DESCRIPTION OF THE DRAWINGS

Preferred features of embodiments of the present invention are disclosed in the accompanying drawings, wherein similar reference characters denote similar elements throughout the several views, and wherein.

DETAILED DESCRIPTION

Figure 1:
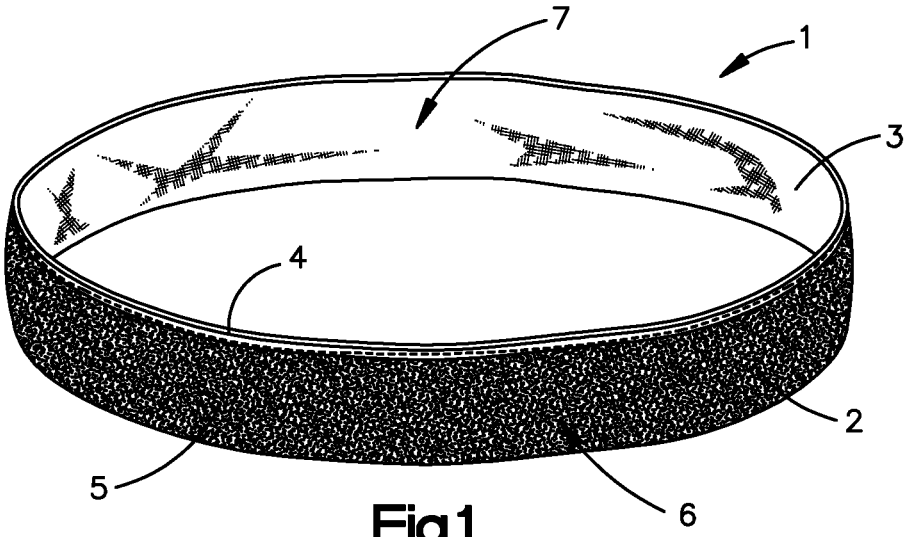
FIG. 1 is a top/side perspective view of a first embodiment of a headband with a 360-degree glitter pattern on the outside thereof.
Figure 2:
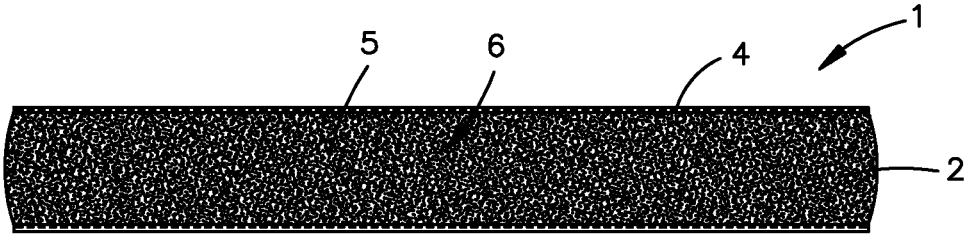
FIG. 2 is a front side view of a headband with a 360-degree glitter pattern as shown in FIG. 1.
Figure 3:
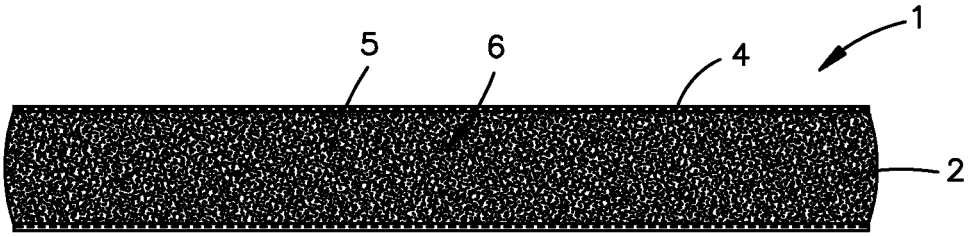
FIG. 3 is a rear side view of a headband with a 360-degree glitter pattern as shown in FIG. 1.
Figure 4:
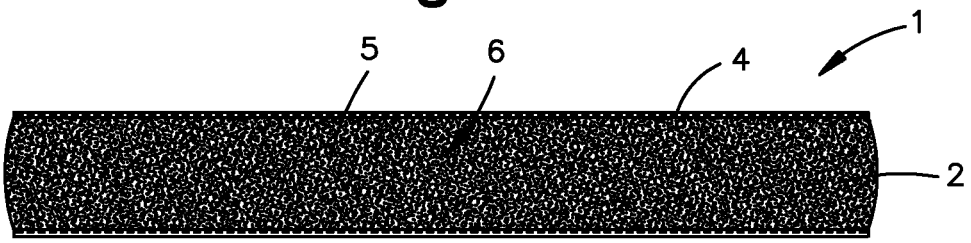
FIG. 4 is a left side view of a headband with a 360-degree glitter pattern as shown in FIG. 1.
Figure 5:
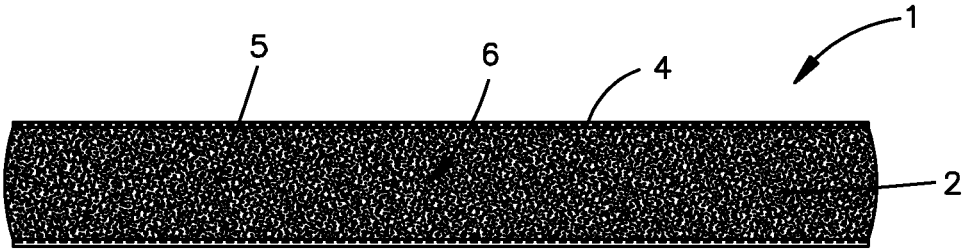
FIG. 5 is a right side view of a headband with a 360-degree glitter pattern as shown in FIG. 1.
Figure 6:
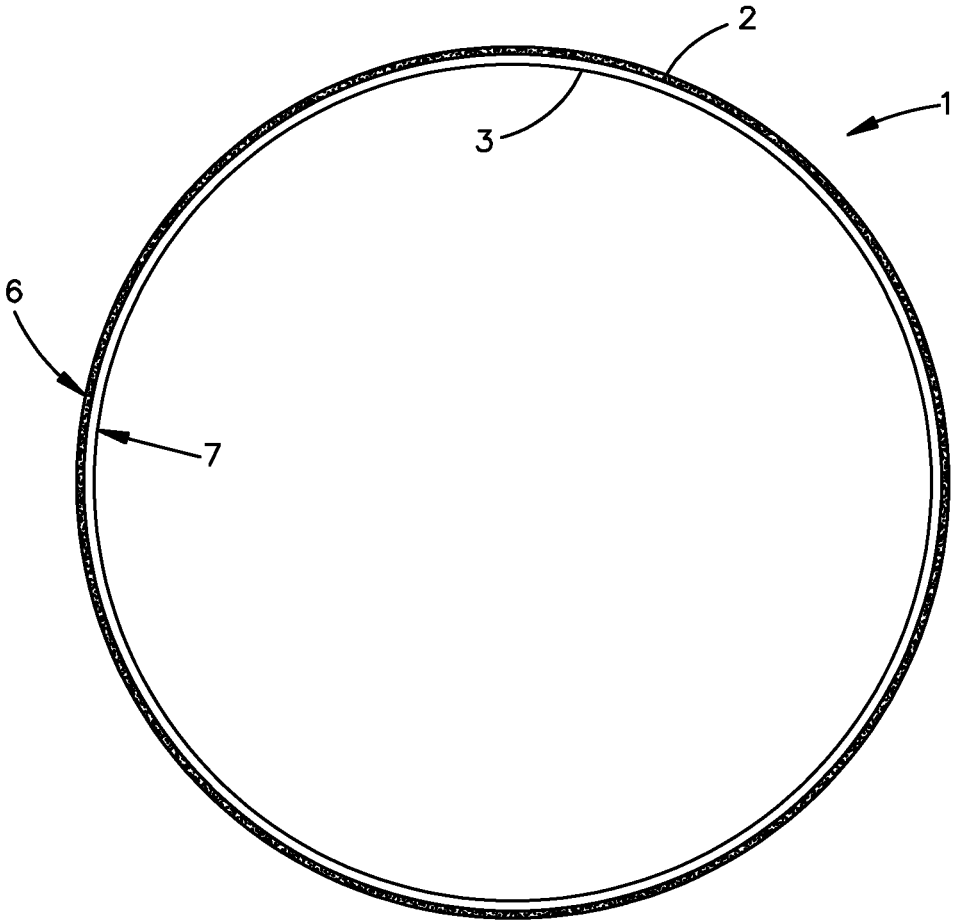
FIG. 6 is a top plan view of a headband with a 360-degree glitter pattern as shown in FIG. 1.
Figure 7:
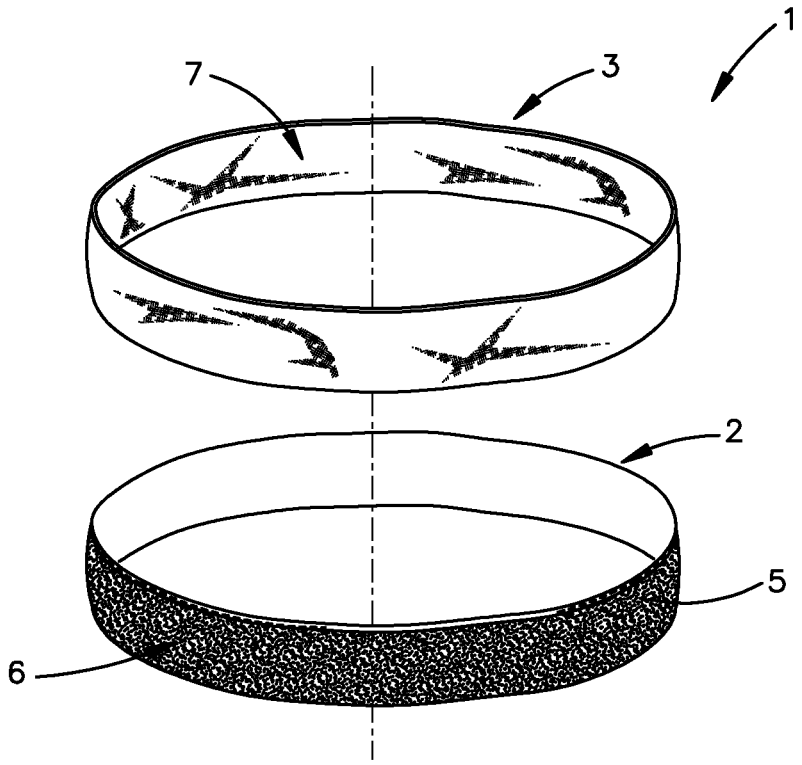
FIG. 7 is an exploded view of a headband with a 360-degree glitter pattern as shown in FIG. 1, showing the stretch velvet ribbon and the elastic glitter ribbon.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "upper," "lower," "inside," "outside" and the like, are words of convenience and are not to be construed as limiting terms.

Preferred features of the embodiments of the present invention are disclosed in the accompanying drawings. The figures filed herewith generally depict a headband that includes non-slip, no headache and non-snag properties with a preferred 360-degree glitter pattern. Specifically, the figures filed herewith show a headband that: improves grip on a wearer's head because of its non-slip features, prevents headband headaches, offers advantages in preventing snagging in a wearer's hair, and provides an aesthetically appealing headband with a preferred 360-degree glitter pattern, while providing the non-slip, no headache, non-snag features described herein. Applicant, as her own lexicographer, notes that the use of "substantially 360-degree glitter pattern" in the claims includes headbands with 270 degrees (e.g., three quarters of 360 degrees) to 360 degrees of glitter. In addition, Applicant, as her own lexicographers, further notes that "glitter" does not mean that glitter resides on the surface of a material to cause the headband to sparkle brightly but it means the materials and patterns used in the headband cause it to sparkle. For example, a "glitter pattern" according to the aspects of the present invention includes a ribbon with metallic threading and/or metallic yarn that gives the appearance of glitter.

As shown in the accompanying figures, the design for a non-slip, no headache, non-snag headband with a 360-degree glitter pattern of the embodiments of the present invention include a band with a 360-degree view of a glitter pattern with no "break" like other headbands known in the art. One of the characteristic features of the design of the headband of the present invention resides in the glitter pattern that completely encircles the headband. In the accompanying figures, the glitter pattern is shown as specks of black and white that encircle the entire headband on the outside thereof.

The embodiments of the present invention include a non-slip, no headache, non-snag headband that does not cause a headache and can withstand extreme conditions that may be experienced during running/exercising or the like. The headband of the embodiments of the present invention work from both a visual and utility perspective. The width of the headband in the embodiments of the present invention may vary. For example, in one embodiment of the present invention the width of the headband is ⅜-inch, and in a different embodiment of the present invention the width of the headband is ⅝-inch. However, one skilled in the art will readily understand that the sizes of the headband may vary from those specifically described herein and that the embodiments of the present invention are in no way limited to a certain size/width. For example, the "headband" as referred to in this patent application may include a bandana that covers a greater surface of a user's head than a ⅜ inch or ⅝ inch headband as long as the bandana is made by the novel "stretch and stitch" method recited in the claims and described herein. Additionally, the embodiments of the present invention may be colored in numerous colors and color combinations.

As depicted in the figures, the headband 1 of an embodiment of the present invention is made from an elastic glitter ribbon 2 stitched onto a stretch velvet ribbon 3 using a stretch and stitch method. In the stretch and stitch method, both ribbons 2, 3 are stretched out a certain distance as understood by a person of ordinary skill in the art noting that it is difficult to quantity the force, pressure or metrics used to "stretch" the headband before stitching as such stretching is being done, at least at this point, by a seamstress or person skilled in the art of needle point that first stretches the ribbon before stitching the ribbon together. The "stretch and stitch" method as recited in the claims and described herein maintains the elasticity of the two ribbons. The stretch and stitch method of joining the ribbons provides for the most reliability, durability, and visual appeal. If a standard stitch was used to join the two ribbons, the elasticity of the two ribbons would decrease or be taken away entirely, and/or the stitching would snap. In an embodiment of the present invention, the stitch/thread 4 is visible on the outside of the headband 1. Although the headbands as described herein are made by hand, it is understood that claim recitations in patent applications cover future, prospective designs including machines deployed in the future to "stretch and stitch" the two ribbons. Also, automated methods and machines may be used for cutting and cleaning processes such as used for loose threads.

In a preferred example, a first circle is made using the elastic glitter ribbon 2 or a plain elastic ribbon and a second circle is made using the velvet ribbon 3. In this first step, the ends of the elastic glitter ribbon 2 are connected to make the first elastic ribbon circle, and the ends of the stretch velvet ribbon 3 are connected to make the second velvet ribbon circle. In a second step, the circles are put together such that one is on the outside and the other is on the inside. In a third step, the circles are stretched as they are sewn or attached together, and stretched simultaneously during the sewing or attachment process, such that the circles are stretched as the needle hits the ribbons. The outside of the headband 1 may have a 360-degree view of the glittery appearance 5 with no "break."

In the embodiments of the present invention, the outside surface 6 of the headband 1 sparkles because the elastic glitter ribbon 2 has a sparkly or glittery appearance 5, which can be achieved in a variety of ways as described above. The elastic glitter ribbon 2 may be a variety of colors and a variety of sizes. As noted above, a "glitter pattern" includes a ribbon with metallic threading and/or metallic yarn that gives the appearance of glitter.

The bottom surface of the stretch velvet ribbon 3 forms the inside surface 7 of the headband 1. In an embodiment of the present invention, the bottom surface of the stretch velvet ribbon 3 is made of a velvet material. The velvet bottom prevents slipping and snagging (i.e., hair pulling) on a wearer's head. Additionally, the velvet inside surface 7 of the headband 1 creates a comfortable feel on a wearer's head so as not to cause a headband headache. If the velvet bottom surface of the stretch velvet ribbon 3 was not present in an embodiment of the present invention, any plain ribbon (elastic or not) would slip right off a wearer's head. This is because the velvet material acts to grip the hair, without snagging the hair of a wearer. This is especially true when exercising.

In an embodiment of the present invention, the stretch velvet ribbon 3 is lush with a resplendent look and is woven with the elasticity required for the headband 1 of the embodiments of the present invention. The stretch velvet ribbon 3 may be a variety of colors and a variety of sizes. In an embodiment of the present invention the stretch velvet ribbon 3 is made of approximately 80% nylon and approximately 20% elastomer (a person of ordinary skill in the art would under that "approximately" used in this context means "within a few percentage points"). However, one skilled in the art will understand that the embodiments of the present invention are not limited to the materials described herein for either the elastic glitter ribbon 2 or the stretch velvet ribbon 3.

Moreover, the elastic properties of the headband 1 of the embodiments of the present invention prevent headband headaches because the fit of the headband 1 is not too tight and the headband 1 does not have a limited flexibility. The headband 1 of the embodiments of the present invention molds to a wearer's head because the headband 1 encircles the entire head with no break.

The embodiments of the present invention provide for the most functionality and highest level of visual appeal. In other embodiments of the present invention the elastic glitter ribbon 2 may be replaced with an elastic ribbon that includes, but is not limited to, various textured ribbons, fabrics, and fasteners including but not limited to sequins, spandex, polyester blends, beading, silicone, toggles, tapes, buttons, hooks, sliders, Velcro, gimp, and/or puff paint.

The embodiments of the present invention are improvements from the headbands of the prior art. For example, many similar prior art headbands do not stretch for 360-degrees of the headband—they use a piece of black elastic on the back of the headband to provide the "stretch" on the headband. Additionally, the gripping portion of prior art headbands does not wrap around the entire head of the wearer—the headband stops and the remainder is plain elastic. While most of the headbands of the prior art market their headbands as "no slip," there is still a degree of slide due to the grip not going all the way around the headband, and therefore not going all the way around the wearer's head. These headbands of the prior art cause a headband headache due to their lack of elasticity.

In an alternative embodiment of the present invention, the stretch velvet ribbon 3 is substituted for a stretch silicone backing. In an embodiment of the present invention, the stretch silicone backing is an elastic band with silicone applied to its bottom surface (the surface that will contact the wearer's head while in use).

In another embodiment of the present invention, the stretch velvet ribbon 3 is eliminated entirely, and silicone backing is attached directly to the elastic glitter ribbon 2. The silicone backing may cover the entire back of the elastic glitter ribbon 2, or it may be applied only to a section of the back of the elastic glitter ribbon 2. For example, the silicone backing may only be a strip of silicone down the middle of the ribbon.

As discussed above, the embodiments of the present invention may be manufactured in many different colors and/or color combinations. For example, in an embodiment of the present invention, the elastic glitter ribbon 2 and the stretch velvet ribbon 3 may be color coordinated, and in another embodiment they may be different colors.

In another embodiment of the present invention, the elastic glitter ribbon 2 is substituted for an elastic ribbon that contains no glitter.

In an embodiment of the present invention, the headband does not have limited flexibility.

The embodiments of the present invention are intended for use by all sexes and ages. The embodiments of the present invention may be used while exercising, for general comfort, or as a fashion accessory. The embodiments of the present invention may be used as a device to keep hair out of a wearer's face/eyes, as a sweatband, or for any other purposes a person might wear a headband.

It is understood to one skilled in the art that although the headbands 1 of the embodiments of the present invention are preferably situated for use as a human headband, there may be other alternative uses. For example, the headbands 1 of the embodiments of the present invention may be used as leashes or collars for animals such as dogs or cats.

Figure 8:
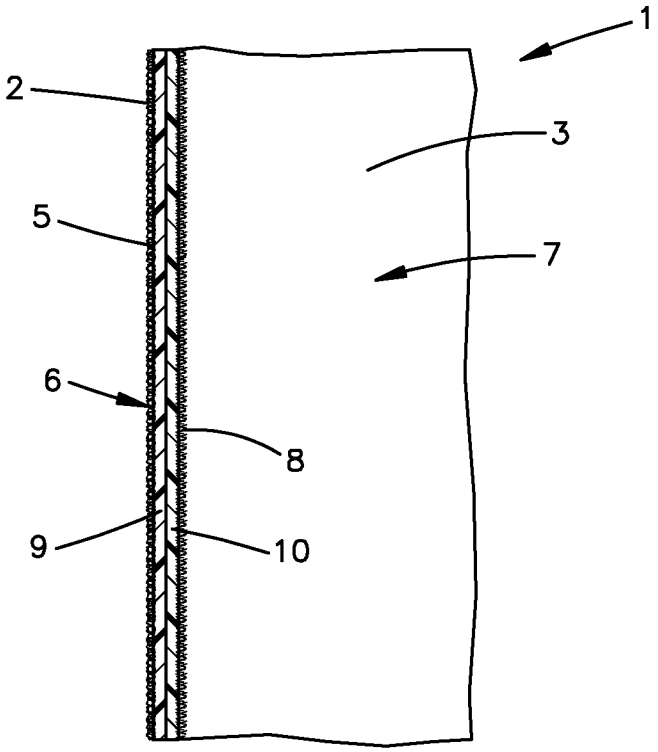
FIG. 8 is a cross-sectional view of a headband with a 360-degree glitter pattern.

FIG. 8 depicts a cross-sectional view of a headband 1 according to an embodiment of the present invention. As depicted in FIG. 8, the elastic glitter ribbon 2 and the stretch velvet ribbon 3 include at least two layers, where the outside layer of the elastic glitter ribbon 2 corresponds to the outside surface 6 of the headband and the outside layer of the stretch velvet ribbon 3 corresponds to the inside surface 7 of the headband 1. The outside layer of the elastic glitter ribbon 2 includes the glittery appearance 5, which encircles the entire outside surface 6 of the headband 1 in an embodiment of the present invention. The outside layer of the stretch velvet ribbon 3 includes a velvet-like material 8, which encircles the entire inside surface 7 of the headband 1 in an embodiment of the present invention. The inside layer of the elastic glitter ribbon 2 includes an elastic material 9 or the like, such that the elastic glitter ribbon 2 has elastic properties in an embodiment of the present invention. Similarly, the inside layer of the stretch velvet ribbon 3 includes an elastic material 10 or the like, such that the stretch velvet ribbon 3 has elastic properties in an embodiment of the present invention.

Applicants note that parent patent application Ser. No. 13/978,391 is based on information provided in a provisional patent application filed on Jul. 28, 2011, almost 4 years ago. Applicant received a notice of allowance in application Ser. No. 13/978,391 on May 22, 2015, and paid the issue fee on Jun. 2, 2015. This CIP is being submitted to clarify certain aspects of the present invention as provided above and to include other information. In general, the product line utilize the novel "stretch and stitch" method with velvet to make the headbands. However, in certain embodiments, the outside ribbon is different as metallic threading ribbon and/or metallic yarn may be used in unique pattern.

Figure 9:
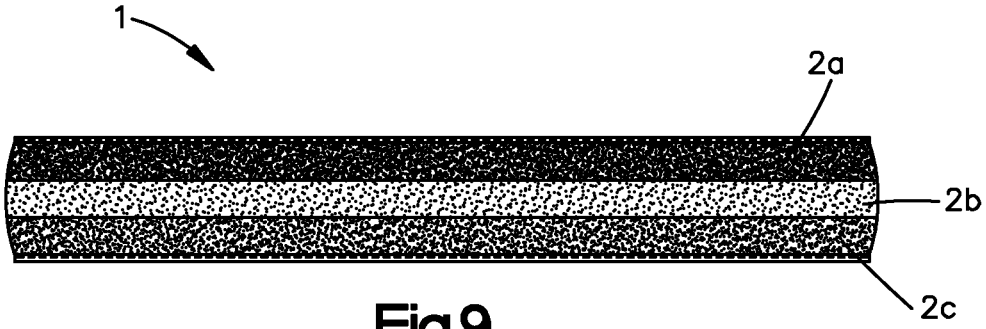
FIG. 9 is a diagram illustrating an example of a headband including two or more different colored metallic threading ribbons and/or metallic yarn forming patterns.

Referring to FIG. 9, a headband 1 may include metallic threading ribbon and/or metallic yarn forming patterns by using two or more different colored metallic threading and/or metallic yarn. In this example, three different colored metallic threading and/or metallic yarn 2*a*, 2*b*, 2*c* are used and create a horizontally stripped pattern. Other patterns may include stripped patterns, polka dots, and any patterns using different colored metallic threading and/or metallic yarn 2*a*, 2*b*, 2*c*.

Figure 10:
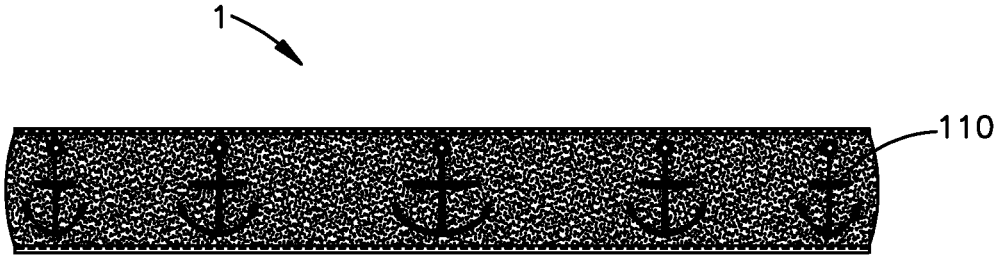
FIG. 10 is a diagram illustrating an example of a headband including a logo printed thereon.
Figure 11:
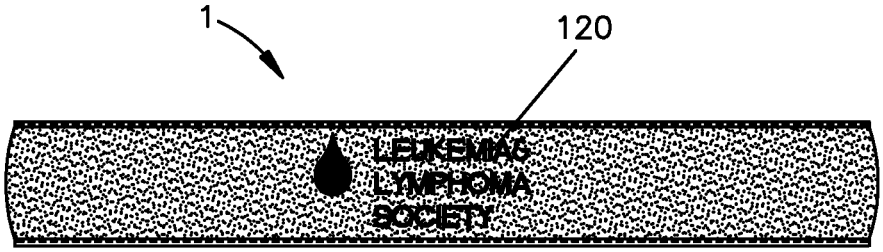
FIG. 11 is a diagram illustrating an example of a headband including writing or indicia printed thereon.

Also, the metallic threading and/or metallic yarn may be used as a base for adding designs without being used to make a pattern. That is, patterns (or logos) may be printed onto the glitter base headband with various printing methods such as ink, foil heat transfer, and other printing methods that should be appreciated by those of skill in the art. As illustrated in FIGS. 10 and 11, printed logo 110, brand names 120, or other indicia may be included onto a glitter base or a plain headband.

Other products include a plain ribbon or pattern ribbon in place of the elastic glitter ribbon. With the plain ribbon, a person of ordinary skill in the art will understand that there is no pattern or specific configuration. However, the user still enjoys the use of a non-slip, no headache, non-snag headband with a substantially 360 degree pattern (meaning no break in the headband). In a pattern ribboned headband, the patterns may include the chevron, polka dots, stripes, or other designs known by a person of ordinary skill in the art. Again, with the pattern design, the user enjoys the use of a non-slip, no headache, non-snag headband with a substantially 360 degree pattern. In addition to the lain or pattern ribbon, the headbands also include a printed ribbon instead of the elastic glitter ribbon—the printed ribbon may include certain designs and logos 110, 120. Moreover, both the plain ribbon and glitter ribbon can have prints on them.

Figure 12:
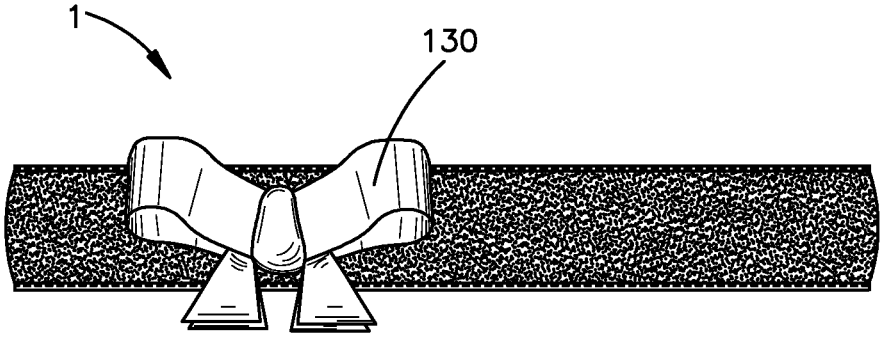
FIG. 12 is a diagram illustrating an example of a headband including ribbon with a bow or flower attachment.

Referring to FIG. 12, other existing products may include a ribbon with a bow or flower attachment 130. They can be plain, pattern or printed ribbons. The attachments 130 are sewn on for decorative purposes as understood by a person of ordinary skill in the art. The metallic threading ribbon and/or metallic yarn (i.e. glitter pattern) can also include a bow or flower attachment 130, and can be provided on plain, pattern or printed glitter ribbons. Patterns (or logos) may be printed onto the plain or glitter base headband with various printing methods such as ink and foil heat transfer.

It should be appreciated that while examples of the headband 2 are illustrated as including a plain or glitter ribbon extending about the entire circumference of the headband 2, other examples of the headband 2 include a plain or glitter ribbon extending about only a region on the outer surface of the headband 2 without extending about the entire circumference. Similarly, it should be appreciated that while examples of the headband 2 are illustrated as including a velvet ribbon or stretch material extending about the entire circumference of the headband 2, other examples of the headband 2 include a velvet ribbon or stretch material extending about only a region on the inner surface of the headband 2.

Figure 13:
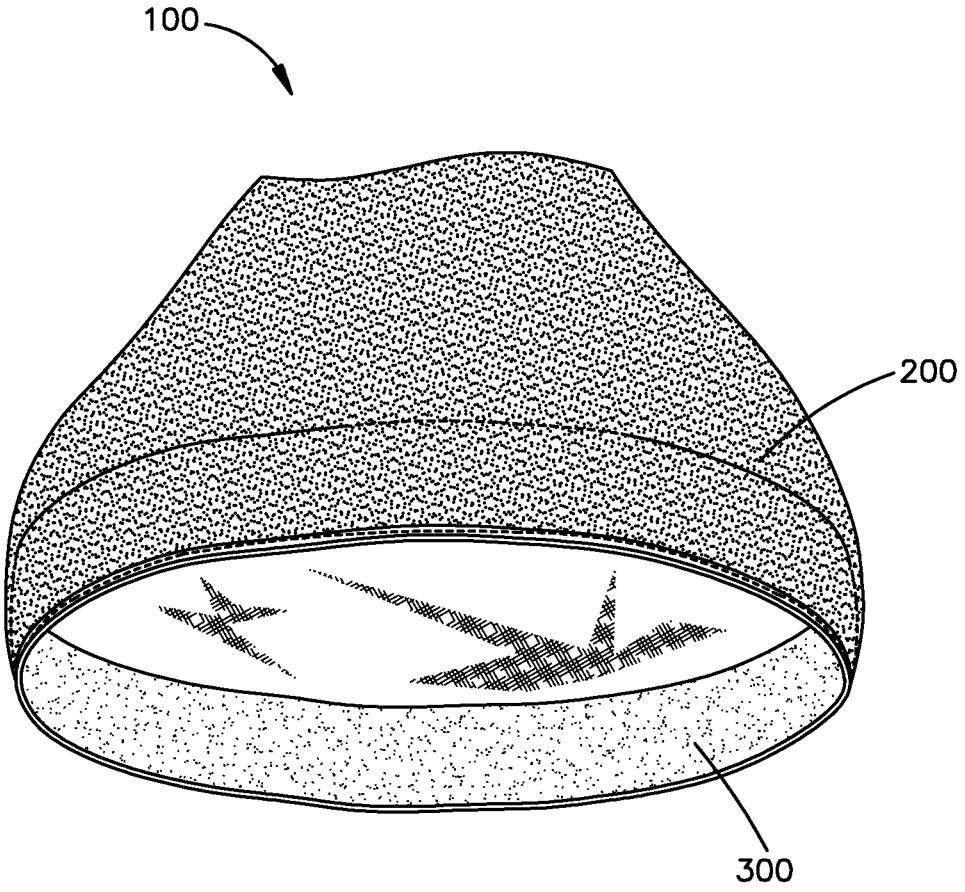
FIG. 13 is a diagram illustrating an example of a bandana or other type of headband with a Lycra outer material and velvet on the inside and around the headband.

Other Sparkly Soul products include a bandana 100 or other type of headband with a Lycra outer material and preferably with velvet all around and on the inside of the headband or bandana 100. As illustrated in the example of FIG. 13, in such a headband, the velvet 300 would be worn at the hairline only or only at the edge of the bandana 100, and it would be attached by the novel stretch and stitch method described above. In this example, the ribbon 200 on top is not the same size as the velvet 300 on the bottom. Further, the velvet material 300 covers the entire circumference of the bandana 100 or headband; however, it should be appreciated that this application also includes a partial velvet lining i.e. the inside includes velvet on 75% or 95% of inside an entirely elastic headband. In addition, another embodiment includes an entirely elastic braided headband on the outside using some, none or partial glitter pattern ribbon.

I claim:

1. A headband comprising:

an inside surface and an outside surface;

an elastic glitter ribbon, a top portion of which defines the outside surface of the headband, wherein the elastic glitter ribbon is formed of a uniform elastic material defined by a length extending between opposed first and second ends;

a stretch velvet ribbon, a bottom portion of which defines the inside surface of the headband, wherein the stretch velvet ribbon has a uniform elasticity defined by a length of velvet-like material extending between opposed first and second ends, metallic thread stitching in the form of stretch and stitch directly attaching the elastic glitter ribbon to the stretch velvet ribbon along the length of the elastic glitter ribbon and the stretch velvet ribbon, the stitching maintaining the elasticity of the elastic glitter ribbon and the stretch velvet ribbon, wherein the first end and second end of the elastic glitter ribbon are directly connected to one another via a seam, and the first end and the second end of the stretch velvet ribbon are directly connected to one another via a seam, such that the elastic glitter ribbon and stretch velvet ribbon create a 360-degree elastic headband, wherein the bottom portion of the stretch velvet ribbon comprises a 360-degree gripping portion, wherein the bottom portion of the stretch velvet ribbon is configured to grip hair of the user when worn, wherein the headband is configured to provide a 360-degree view of the outside surface of the headband.

2. The headband according to claim 1, further comprising a bow or flower attachment that is attached to the elastic glitter ribbon on an outer surface of the headband.

3. The headband according to claim 1, wherein the elastic glitter ribbon comprises metallic threading ribbon or metallic yarn having two or more different colors for creating patterns on an outer surface of the headband.

4. The headband according to claim 1, wherein the headband has a width of ⅜-inch or a width of ⅝ inch.

5. The headband according to claim 1, wherein the stitching in the form of stretch and stitch comprises a visible stitch/thread on the outside of the elastic glitter ribbon.

6. The headband according to claim 1, wherein the stitching in the form of stretch and stitch does not yield a visible stitch/thread on the outside of the elastic glitter ribbon.

7. The headband according to claim 1, wherein the velvet-like material that forms a gripping portion is comprised of nylon and elastomer.

8. The headband according to claim 1, wherein the elastic glitter ribbon and the velvet stretch ribbon are the same color.

9. The headband according to claim 1, wherein the elastic glitter ribbon and the velvet stretch ribbon are a different color.

10. The headband of claim 1, wherein the stretch velvet ribbon comprises a single piece of material formed in a loop.

11. The headband of claim 1, wherein the stretch velvet ribbon comprises a single piece of material of uniform width.

12. The headband of claim 1, wherein the stretch velvet ribbon comprises a single piece of material of uniform elasticity.

13. The headband of claim 1, wherein the elastic ribbon is a woven elastic ribbon.

14. The headband of claim 1, wherein the elastic ribbon has a uniform construction around the 360 degrees of the headband.

15. The headband of claim 1, wherein the elastic ribbon comprises an elongated ribbon formed into a loop in which a first end of the elastic ribbon is connected directly to a second end of the elastic ribbon.

16. The headband of claim 1, wherein the inside of the headband includes 360 degrees of elastic material formed by a first end of the stretch velvet ribbon being connected directly to a second end of the stretch velvet ribbon.

17. The headband of claim 1, wherein the outside of the headband includes 360 degrees of elastic material.

18. The headband of claim 1, wherein the stitching extends along a length of the elastic glitter ribbon.

19. A headband comprising:

an inside surface and an outside surface;

an elastic ribbon, a top portion of which defines the outside surface of the headband, wherein the elastic ribbon is formed of a uniform elastic material defined by a length extending between opposed first and second ends;

a stretch ribbon, a bottom portion of which defines the inside surface of the headband, wherein the stretch ribbon has a uniform elasticity defined by a length of material extending between opposed first and second ends, stitching in the form of stretch and stitch directly attaching the elastic ribbon to the stretch ribbon along the length of the elastic ribbon and the stretch ribbon, the stitching maintaining the elasticity of the elastic ribbon and the stretch ribbon, wherein the first end and second end of the elastic ribbon are directly connected to one another via a seam, and the first end and the second end of the stretch ribbon are directly connected to one another via a seam, such that the elastic ribbon and stretch ribbon create a 360-degree elastic headband, wherein the bottom portion of the stretch ribbon comprises a 360-degree gripping portion, wherein the bottom portion of the stretch ribbon is configured to grip hair of the user when worn, wherein the headband is configured to provide a 360-degree view of the outside surface of the headband.

20. The headband according to claim 19, further comprising a bow or flower attachment that is attached to the elastic ribbon on an outer surface of the headband.

21. The headband according to claim 19, wherein the elastic ribbon comprises various textures, fabrics and fasteners with one or more of the following: sequins, spandex, polyester blends, beading, silicone, toggles, tapes, buttons, hooks, sliders, hook-and-loop fasteners, gimp, and/or puff paint.

22. The headband according to claim 19, wherein the stretch ribbon comprises a stretch silicone backing.

23. The headband according to claim 22, wherein the stretch silicone backing is an elastic band with silicone applied to its bottom surface.

24. The headband of claim 19, wherein the outside of the headband includes 360 degrees of elastic material.

25. The headband of claim 19, wherein a first end of the elastic ribbon is connected directly to a second end of the elastic ribbon.

26. The headband of claim 19, wherein the stitching extends along a length of the elastic ribbon.

27. The headband of claim 26, wherein the outside of the headband includes 360 degrees of elastic material.

28. A headband comprising:

an inside surface and an outside surface;

an elastic ribbon, a top portion of which defines the outside surface of the headband, wherein the elastic ribbon is formed of a uniform elastic material defined by a length extending between opposed first and second ends;

a stretch velvet ribbon, a bottom portion of which defines the inside surface of the headband, wherein the stretch velvet ribbon has a uniform elasticity defined by a length of velvet or velvet-like material extending between opposed first and second ends, stitching in the form of stretch and stitch directly attaching the elastic ribbon to the stretch velvet ribbon along the length of the elastic ribbon and the stretch velvet ribbon, the stitching maintaining the elasticity of the elastic ribbon and the stretch velvet ribbon, wherein the first end and second end of the elastic ribbon are directly connected to one another via a seam, and the first end and the second end of the stretch velvet ribbon are directly connected to one another via a seam, such that the elastic ribbon and stretch velvet ribbon create a 360-degree elastic headband, wherein the headband is configured to provide a 360-degree view of the inside and outside surfaces of the headband.

29. The headband of claim 28, wherein the stitching extends along a length of the elastic ribbon.

30. A headband comprising:

an inside surface and an outside surface;

an elastic ribbon having a top surface and a bottom surface, the top surface defining the outside surface of the headband, wherein the elastic ribbon is formed of a uniform elastic material defined by a length extending between opposed first and second ends;

a stretch ribbon having a top surface and a bottom surface, the bottom surface defining the inside surface of the headband, wherein the stretch ribbon has a uniform elasticity defined by a length of material extending between opposed first and second ends, stitching in the form of stretch and stitch attaching the elastic ribbon to the stretch ribbon such that the bottom surface of the elastic ribbon is directly coupled to the top surface of the stretch ribbon along their entirety, the stitching maintaining the elasticity of the elastic ribbon and the stretch ribbon, wherein the first end and second end of the elastic ribbon are directly connected to one another via a seam such that the elastic ribbon and stretch ribbon create a 360-degree elastic headband;

wherein the bottom surface of the stretch ribbon comprises an unbroken and consistent 360-degree gripping portion configured to grip hair of the user when worn, wherein the headband is configured to provide a 360-degree view of the outside surface of the headband.

31. The headband of claim 20, wherein the bottom surface of the elastic ribbon is attached directly to the top surface of the stretch velvet ribbon along an entire length of the stretch velvet ribbon.

32. A headband comprising:

an inside surface and an outside surface;

an elastic ribbon having a top surface and a bottom surface, the top surface defining the outside surface of the headband, wherein the elastic ribbon is formed of a uniform elastic material defined by a length extending between opposed first and second ends;

a stretch ribbon having a top surface and a bottom surface, the bottom surface defining the inside surface of the headband, wherein the stretch ribbon has a uniform elasticity defined by a length of velvet, or velvet-like material extending between opposed first and second ends, stitching in the form of stretch and stitch attaching the elastic ribbon to the stretch ribbon such that the bottom surface of the elastic ribbon is directly coupled to the top surface of the stretch ribbon along their entirety, the stitching maintaining the elasticity of the elastic ribbon and the stretch ribbon, wherein the first end and second end of the elastic ribbon are directly connected to one another via a seam such that the elastic ribbon and stretch ribbon create an unbroken and consistent 360-degree elastic headband.

33. A headband comprising:

an elongated piece of elastic material, a top portion of which forms the outside of the headband, the elongated piece of elastic material being a uniform elastic material around 360 degrees of the headband, wherein a first end of the elongated piece of elastic material is connected to a second end of the elongated piece of elastic material at a seam region;

an elongated piece of stretch velvet material, a bottom portion of which forms the inside of the headband, wherein the stretch velvet material has an elasticity, and wherein a first end of the elongated piece of stretch velvet material is connected to a second end of the elongated piece of stretch velvet material at the seam region;

stitching in the form of stretch and stitch attaching the elongated piece of elastic material to the elongated piece of stretch velvet, the stitching maintaining the elasticity of the elongated piece of elastic material and the elongated piece of stretch velvet material, wherein the headband includes 360 degrees of elastic material.

* * * * *